US006089592A

United States Patent [19]

Negus

[11] Patent Number: 6,089,592

[45] Date of Patent: Jul. 18, 2000

[54] SKI OR SKATEBOARD HARNESS ASSEMBLY

[76] Inventor: Ted W. Negus, 19422 Highridge Way, Trabuco Canyon, Calif. 92679

[21] Appl. No.: 08/982,262

[22] Filed: Dec. 1, 1997

[51] Int. Cl.[7] ..... A63C 9/00

[52] U.S. Cl. ..... 280/620; 280/637; 280/619; 280/11.36; 280/87.042

[58] Field of Search ..... 280/601, 637, 280/11.36, 809, 811, 87.042, 14.2, 619–622

[56] References Cited

U.S. PATENT DOCUMENTS

| | | | |
|---|---|---|---|
| 899,963 | 9/1908 | Ferguson | 280/11.36 |
| 3,994,511 | 11/1976 | Gronseth | 280/637 |
| 4,403,785 | 9/1983 | Hottel | 280/14.2 |
| 5,026,088 | 6/1991 | Stuart | 280/14.2 |
| 5,145,202 | 9/1992 | Miller | 280/637 |
| 5,564,729 | 10/1996 | Gomez et al. | 280/637 |

*Primary Examiner*—Brian L. Johnson
*Assistant Examiner*—Deanna Draper

[57] ABSTRACT

A device is provided which secures one's leg and foot to a moving plane such as a skate board or ski board. The device comprises a first strap wrapped around the user's leg beneath the knee and above the calf. A second strap attached to the first strap and removably attached to the moving plane. Means are provided to hold the second strap in tension and to connect the second strap to the board.

3 Claims, 2 Drawing Sheets

SKI OR SKATEBOARD HARNESS ASSEMBLY

BACKGROUND OF THE INVENTION

The Invention relating generally to the devices to secure a person's leg to a moving plane such as a skate board, skiing board and the like, wherein a person's foot is secured on such moving plane.

Devices such as skateboards, ski boards and the like have become popular in recent years and have been used in various sporting events. However, the use of such boards have resulted in injury to the user when the skate board or ski board becomes disengaged from the user.

It is desirable to have one's leg and foot secured to such moving board or plane.

Various devices have been utilized in an attempt to secure one's leg and foot to the moving board or plane. For example, U.S. Pat. No. 3, 994,511 to Gronseth shows a strap assembly attached to a skier's leg and the front area of the ski ahead of the ski binding and which supplements the attachment means of the binding. Such a device is useful but cannot be applied to a board which does not include a binding or the equivalent thereof. U.S. Pat. No. 4,040,639 to Scardenzan again shows a flexible line 24 which may be attached a belt of the operator to be used in conjunction with a foot binding permanently attached to the board. Again, the binding attaches the foot of the user to the board. U.S. Pat. No. 5,145,202 to Miller shows a flexible strap utilized in conjunction with a foot binding.

In some applications there is no foot binding. In some instances it may be desirable for one to use a board which does not include any foot binding in which case there is a need to secure one's leg to the moving board.

Accordingly, there is a need in the art to provide means to secure one's leg to a board wherein there is no foot binding attached to the board to secure the foot to the board.

Applicant's Invention serves a need in the art wherein the user's foot can be secured to the board without the necessity of a binding and further to secure one's foot to the board wherein there is no binding. In some instances a foot binding is not used nor is it desired. In those instances, the invention herein serves as a substantial improvement in the art and fulfills a obvious need.

Accordingly, one object of the Invention is to provide a device wherein one's leg and foot is secured to a moving plane. Another object of the Invention is to provide a device wherein one's leg and foot is secured to a moving plane without the use of a foot binding. Other objects of the Invention will be apparent from the following description.

SUMMARY OF THE INVENTION

The device of the Invention comprises (1) a first strap placed about the user's leg beneath the knee and above the calf; (2) a second strap attached to the first strap and to a device removably attached to the moving plane; (3) attachment means so that the second strap can be removably attached to the moving plane.

The second strap is maintained in sufficient tension so that the leg is maintained secure to the moving plane. Tension means are in communication with such so that the device can be utilized by users who have different sizes.

DETAILED DESCRIPTION OF THE INVENTION

The Invention comprises a first strap placed around the user's leg; a second strap, held in tension, connected to the first strap and to the board; and attachment means for connecting the second strap to the board. Applicant has conceived and reduced to practice the subject Invention and two means for attaching the second strap to the board.

Figure 1:
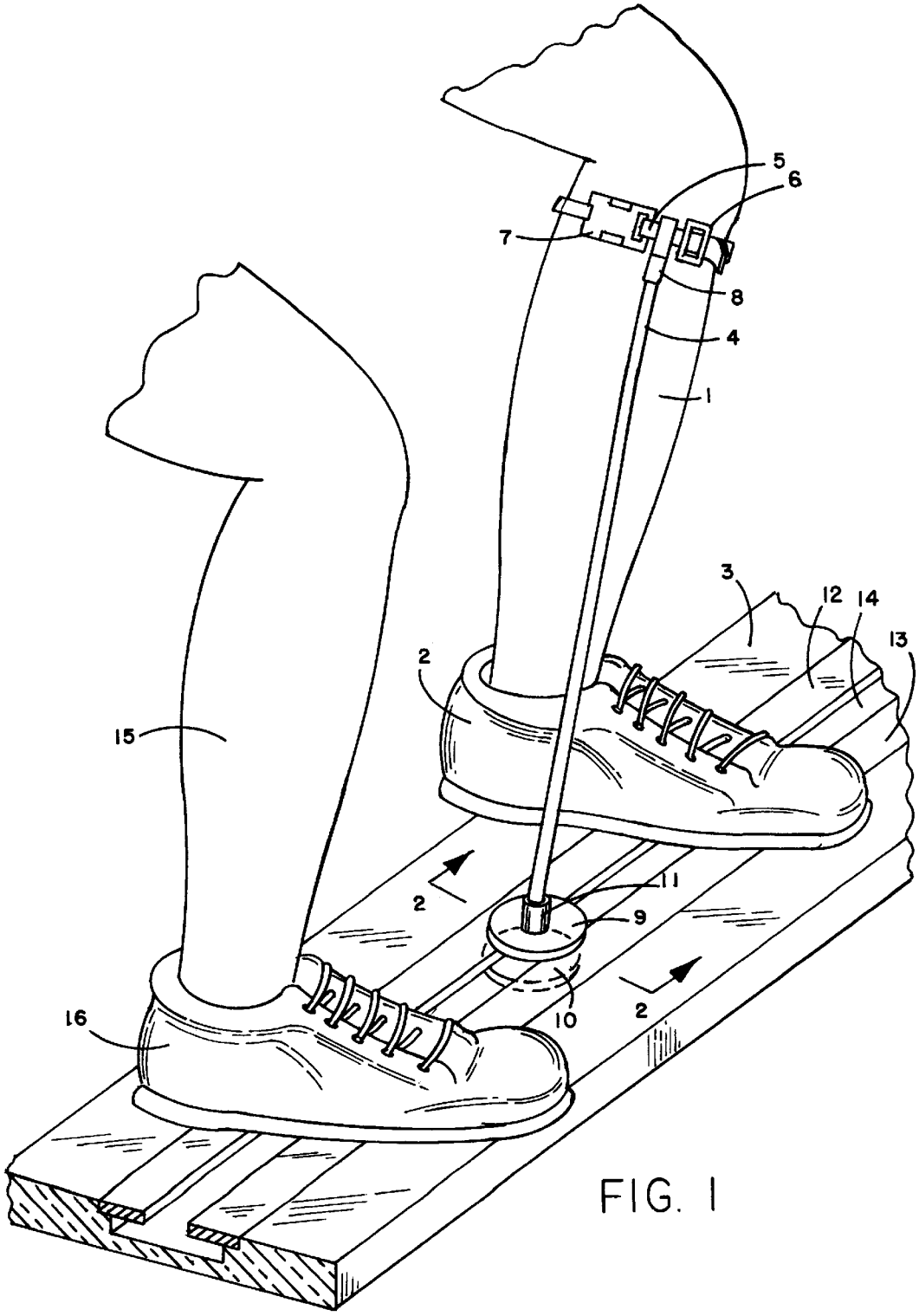
FIG. 1 is a perspective view of the Invention showing the harness of the Invention attached to the user's leg and to a skate board utilizing the attachment means.

FIG. 1 shows the user's leg 1 and foot 2 placed on a moving board 3. The moving board 3 can be a skate board, ski board or any other moving board or plane to which a user's foot is placed thereon. Strap 4 is shown connected to attachment means and to a strap 5. Strap 5 is placed around the user's leg below the knee and above the calf. Buckle means 6 and 7 are utilized to hold buckle 5 in tension and secure around the user's leg. There is an adjusting buckle 8 to place strap 4 in tension so that there can be substantially no flexibility in strap 4. The user's foot 2 and leg 1 are secured to the board by virtue of strap 4 held in substantial tension. Strap 4, as adjusted utilizing the adjusting buckle 8 has a length substantially that of the user's leg below the calf and to the user's bottom of his or her foot. Thus there is substantially little or no flexibility in strap 4. FIG. 1 also shows the user's other leg 15 and foot 16. The Invention can also be utilized to secure the user's other leg 15 to the board or, alternatively, the Invention can be utilized only to secure one leg to the board. It is generally preferable to secure both legs to the board utilizing the subject Invention.

Adjusting buckles 6 and 7 are shown in communication with the strap 5 placed about the user's leg and which serves exclusively to place tension on the user's leg. Adjusting buckle 8 is shown in communication with strap 4.

Figure 2:
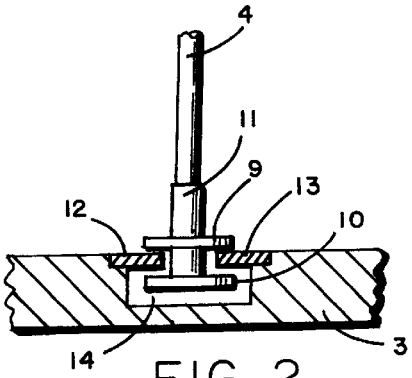
FIG. 2 shows a detail view of the attachment means generally depicted in FIG. 1.

The board 3 includes no foot binding. The foot 2 is simply placed on the board. Strap 4 is shown attached to the board by two "slide washers" 9 and 10. One washer 9 is shown in communication with holder 11. The strap is placed within the holder 11. Holder 11 is permanently attached or part of washer 9. Thus the strap is attached to the upper washer 9. Holder 11 is also permanently attached or integral with washer 10. There is a groove portion 14. There are board portions 12 and 13 of board 3. Alternatively there can be placed on board 3 two separate board pieces 12 and 13. The slide washers 9 and 10 are placed about the board portions 12 and 13 as shown in FIG. 1 and FIG. 2.

Referring to FIG. 2 there again is shown washers 9 and 10. Washer 9 is above the board portions 12 and 13. Washer 10 is below board portions 12 and 13. Holder 11 secures the strap 4 and is placed within an integral with washers 9 and 10. Trough portion 14 of the board is shown so that the washer 10 can be placed within the board portion.

The washers 9 and 10 can thus be in sliding communication with the board 3. The user can thus move longitudinally along board 3 resulting in flexibility of movement along the board.

Of course, the attachment means can include means whereby a strap can be moved longitudinally about the board. In such case washers 9 and 10 are simply placed above and below the board. Holder 11 is simply placed through a hole in the board.

As is obvious from the drawings, Applicant has devised a system whereunder the attachment means can be moved along the board resulting in flexibility of attachment and operation.

As discussed above, the harness, strap system and harness means can be applied to the user's second leg for greater stability.

Figure 3:
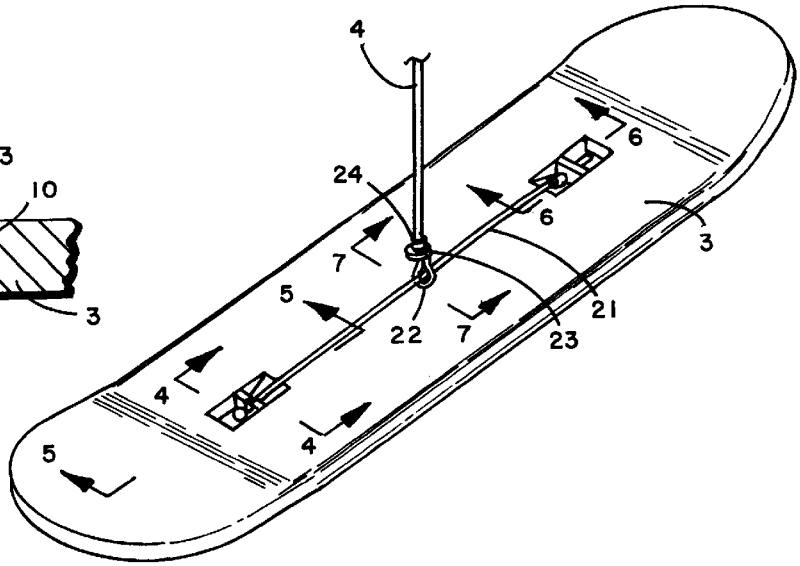
FIG. 3 shows a perspective view of the second strap attached to the moving board utilizing a different attachment means.
Figure 4:
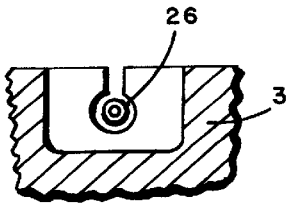
FIG. 4 shows a detail of the portion of the attachment means.

FIG. 3 shows a separate and distinct attachment means whereunder the strap 4 is attached to board 3. As shown, strap 4 is attached to a holder portion 24. The holder 24 is connected to a ring 22. A wire 21 is held in tension as shown along the surface of board 3. Wire 21 is placed within the ring 22.

Figure 7:
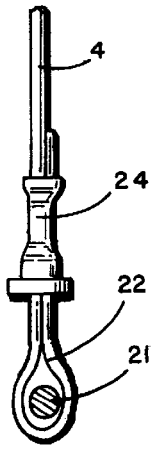
FIG. 7 shows a detail of the means whereunder the strap is attached to connecting means attached to the board.

FIG. 7 shows a detail of the holder 24, ring 22 and wire 21.

Figure 5:
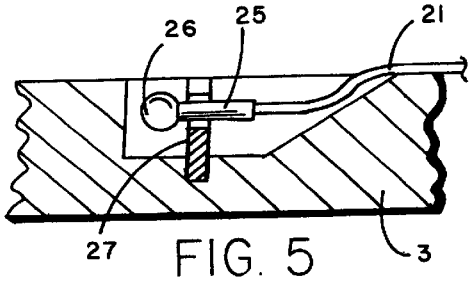
FIG. 5 shows a side view of one of the attachment means.

FIG. 5 shows line or wire 21 connected to a holder 25 placed within a support brace 27. Holder 25 is in communication with a ball 26. Thus the wire or cable 21 is permanently connected to the board 3.

Figure 6:
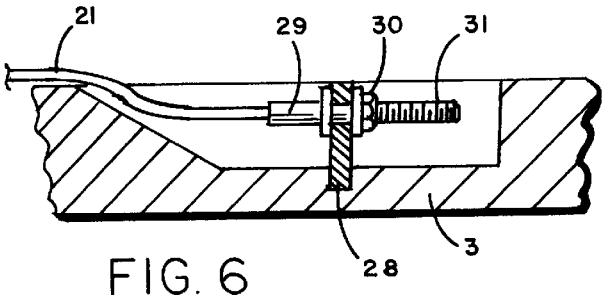
FIG. 6 shows a side view of another portion of the attachment means.

FIG. 6 shows the slide cable 21 attached to board 3 at the opposite end from the end shown in FIG. 5. Cable 21 is connected to a holder 29 and bolting means 30 and 31.

Accordingly, the strap 4 is connected to a wire 21 held in tension and placed along the board. Thus strap 4 can slide longitudinally along board 3. Thus the user's foot may be so adjusted.

In essence, the Invention comprises a novel means to secure one's leg to a moving board or plane. In Applicant's Invention the strap can be moved longitudinally along the board, a concept not suggested by the prior art.

There may be various other means whereunder the second strap can be in communication with the board. Accordingly, the above detail description does not limit the Invention.

I claim:

1. A device to secure one's legs to one skate board or ski board without the use of bindings comprising:

(a) a first strap adapted to wrap around the user's leg below the knee and above the calf;

(b) a second strap removably connected to said first strap;

(c) means for holding the second strap in tension;

(d) means to connect the second strap to the board;

(e) wherein the second strap is held in sliding communication with the board whereunder the user's leg can be moved longitudinally along substantially all of the length of the board.

2. The device of claim 1 wherein two washers are utilized to attach the second strap to the board.

3. The device of claim 2 wherein a slide cable is used to attach the strap in sliding communication with the board.

* * * * *